US007823549B2

(12) United States Patent
Moon et al.

(10) Patent No.: US 7,823,549 B2
(45) Date of Patent: Nov. 2, 2010

(54) SWITCHABLE VALVETRAIN SYSTEM AND METHOD OF OPERATION

(75) Inventors: Joseph J Moon, Clawson, MI (US); William C Albertson, Clinton Township, MI (US); Mike M McDonald, Macomb, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 577 days.

(21) Appl. No.: 11/832,327

(22) Filed: Aug. 1, 2007

(65) Prior Publication Data

US 2009/0031970 A1 Feb. 5, 2009

(51) Int. Cl.
*F01L 9/02* (2006.01)

(52) U.S. Cl. ..... 123/90.12; 123/90.13; 137/625

(58) Field of Classification Search ..... 123/90.12, 123/90.13; 137/511, 625
See application file for complete search history.

(56) References Cited

U.S. PATENT DOCUMENTS 4,167,931 A 9/1979 Iizuka
5,680,841 A * 10/1997 Hu ..... 123/322
7,004,122 B2 * 2/2006 Cornell et al. ..... 123/90.12
7,086,374 B2 * 8/2006 McDonald et al. ..... 123/198 F

FOREIGN PATENT DOCUMENTS

GB 2333322 A 7/1999

* cited by examiner

*Primary Examiner*—Ching Chang
(74) *Attorney, Agent, or Firm*—Quinn Law Group, PLLC

(57) ABSTRACT

A switchable valvetrain system is provided having a control unit and a pressure regulator valve responsive to control signals from the control unit. A pressurized fluid source is provided in communication with the pressure regulator valve. A switchable valvetrain component having a latching mechanism and lubrication circuit in selective communication with the pressurized fluid source through the pressure regulator valve is also provided. The pressure regulator valve is operable to selectively and variably communicate fluid pressure from the pressurized fluid source to the latching mechanism and the lubrication circuit in response to control signals from the control unit. A method of operating the switchable valvetrain system is also provided.

11 Claims, 2 Drawing Sheets

SWITCHABLE VALVETRAIN SYSTEM AND METHOD OF OPERATION

TECHNICAL FIELD

The present invention relates to a switchable valvetrain system for an internal combustion engine and a method of operation.

BACKGROUND OF THE INVENTION

Variable displacement internal combustion engines provide improved fuel economy and torque on demand by operating on the principle of cylinder deactivation, sometimes referred to as Active Fuel Management or Displacement on Demand. During operating conditions that require high output torque, every cylinder of a variable displacement internal combustion engine is supplied with fuel and air (also spark, in the case of a gasoline internal combustion engine) to provide torque for the internal combustion engine. During operating conditions at low speed, low load and/or other inefficient conditions for a variable displacement internal combustion engine, cylinders may be deactivated to improve fuel economy for the variable displacement internal combustion engine and vehicle. For example, in the operation of a vehicle equipped with an eight cylinder internal combustion engine, fuel economy will be improved if the internal combustion engine is operated with only four cylinders during low torque operating conditions by reduced pumping losses. The cylinders that are deactivated will disallow the flow of air through their respective intake and exhaust valves. Since the deactivated cylinders do not allow air to flow, additional losses are avoided by operating the deactivated cylinders as "air springs" due to the compression and decompression of the air in each deactivated cylinder. The deactivation of the valves is typically facilitated by the use of a switchable valvetrain component, such as a switchable hydraulic lash adjuster.

SUMMARY OF THE INVENTION

A switchable valvetrain system is provided having a control unit and a pressure regulator valve, such as a proportional solenoid pressure regulator valve, responsive to control signals from the control unit. A pressurized fluid source is provided in communication with the pressure regulator valve. A switchable valvetrain component having a latching mechanism and lubrication circuit in selective communication with the pressurized fluid source through the pressure regulator valve is also provided. The pressure regulator valve is operable to selectively and variably communicate fluid pressure from the pressurized fluid source to the latching mechanism and the lubrication circuit in response to control signals from the control unit.

A method of controlling a switchable valvetrain component for an internal combustion engine is also provided. The switchable valvetrain component includes a latching mechanism and a lubrication circuit in selective series communication with a pressurized fluid source. Additionally, the latching mechanism is responsive to an activation pressure level operable to begin latching of the latching mechanism and a holding pressure level, higher than the activation pressure level, effective to maintain the operation of the latching mechanism. The method includes selectively and intermittently providing fluid pressure to the lubrication circuit of the valvetrain component at a first fluid pressure level wherein the first fluid pressure is below the activation fluid pressure required to begin latching of the latching mechanism. The method may further include providing fluid pressure to the valvetrain component at a second fluid pressure level wherein the second fluid pressure level is above the activation pressure level to effect operation or latching of the latching mechanism. Subsequently, the fluid pressure to the valvetrain component is decreased to a third fluid pressure level wherein the third fluid pressure level is below the second fluid level and above the holding pressure level such that the operation of latching mechanism is maintained. The method may also include reducing fluid pressure from the third fluid pressure level, below the activation fluid pressure level, to discontinue operation of the latching mechanism.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
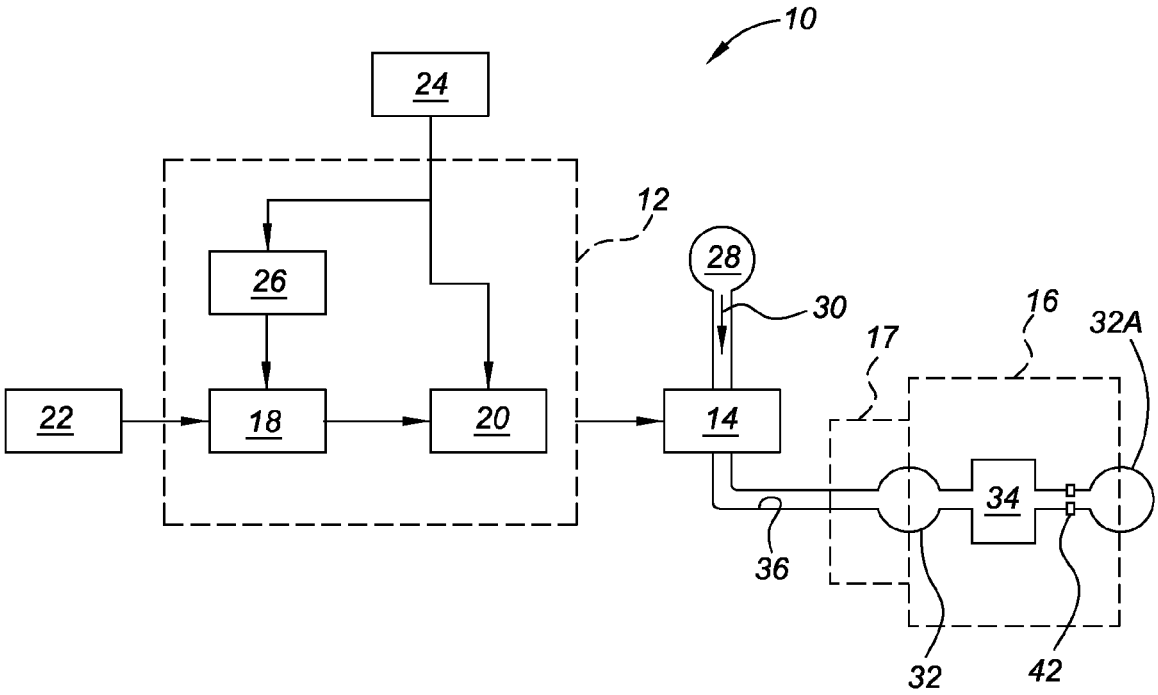
FIG. 1 is a schematic illustration of a switchable valvetrain control system for use with an internal combustion engine.

Referring to the drawings, there is shown in FIG. 1 a schematic depiction of a switchable valvetrain control system, generally indicated at 10. The switchable valvetrain control system 10 is configured for use with a variable displacement internal combustion engine (also known as Active Fuel Management or Displacement on Demand), not shown, and includes a control unit 12, a proportional solenoid regulator valve 14, a switchable valvetrain component 16, such as a rocker arm or finger follower, and a lash adjuster 17. The lash adjuster 17 is engageable with the switchable valvetrain component 16 to account for excess clearance or lash between the switchable valvetrain component 16 and a poppet valve, not shown. The control unit 12 includes a duty cycle control module 18 operable to determine a duty cycle for a pulse width modulation driver 20 in response to various inputs 22. The inputs 22 may include measured or calculated engine oil temperature, engine speed, variable displacement mode activation flag or signal, etc. A system voltage source 24 provides voltage to enable the operation of the duty cycle control module 18 and the pulse width modulation driver 20. Additionally, a system voltage reading circuit 26 is provided to monitor the voltage provided to the duty cycle control module 18 from the system voltage source 24.

The pulse width modulation driver 20 is operable to provide control signals to the proportional solenoid regulator valve 14. The proportional solenoid regulator valve 14 is in fluid communication with a pressurized fluid source 28. The proportional solenoid regulator valve 14 is operable to selectively and variably communicate fluid pressure, indicated by arrows 30, from the pressurized fluid source 28 to the switchable valvetrain component 16, via the lash adjuster 17, in response to control signals from the pulse width modulation driver 20.

The switchable valvetrain component 16 includes lubrication circuits 32 and 32A and a latching mechanism 34. The lubrication circuit 32 is operable to provide lubrication to the interface between the lash adjuster 17 and the switchable valvetrain component 16, while the lubrication circuit 32A is operable to provide lubrication to various valvetrain components, such as camshafts, not shown. The proportional solenoid regulator valve 14 communicates fluid pressure 30 to each of the lubrication circuits 32 and 32A and latching mechanism 34 via passage 36. As such, the lubrication circuits 32 and 32A and latching mechanism 34 are provided in a series flow relation. The lubrication circuit 32A receives fluid pressure 30 through an orifice 42 operable to meter the flow of fluid to the lubrication circuit 32A. The latching mechanism 34 is selectively operable to effect latching or switching of the switchable valvetrain component 16 to enable deactivation of the associated valve, not shown, in response to sufficient fluid pressure 30 supplied through the passage 36. The control strategy or method for controlling the switchable valvetrain control system 10 is discussed in greater detail hereinbelow with reference to FIG. 2.

Figure 2:
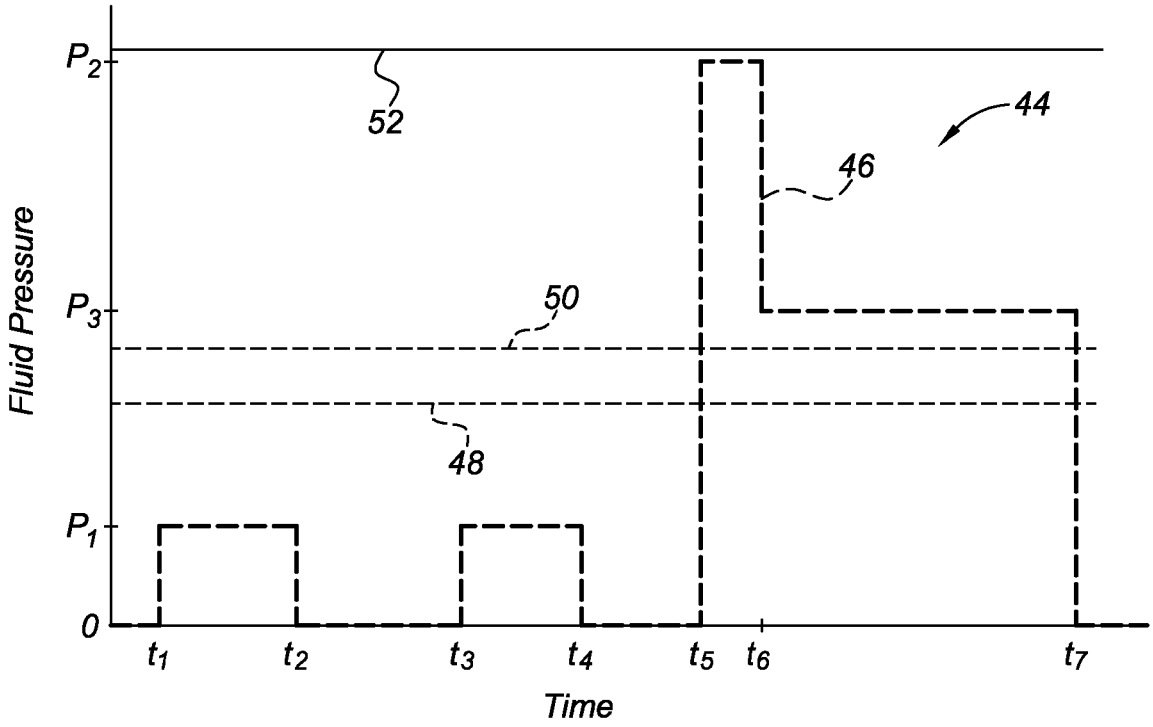
FIG. 2 is a graphical illustration of a method of controlling the switchable valvetrain system of FIG. 1.

Referring to FIG. 2 and with continued reference to FIG. 1, there is shown a graphical representation of an exemplary control strategy or method 44 for controlling the switchable valvetrain control system 10 of FIG. 1. The control method 44 includes a commanded fluid pressure curve 46 which is plotted as a function of time. The activation fluid pressure level is the fluid pressure 30, shown in FIG. 1, required to begin operation or latching of the latching mechanism 34, shown in FIG. 1, and is represented by line 48, shown in FIG. 2, while the holding fluid pressure level is the fluid pressure required to maintain the latching mechanism 34 in the latched or operational state and is represented by line 50. Additionally, line 52 represents the fluid pressure level of the fluid pressure source 28 or supply pressure level.

In accordance with the control method 44, at time $t_1$ the switchable valvetrain component 16 is in an activated state or mode and the control unit 12 commands the proportional solenoid regulator valve 14 to provide fluid pressure at a pressure value $P_1$ to the switchable valvetrain component 16. The pressure value $P_1$ is below the activation fluid pressure level (line 48) such that fluid pressure is provided to the lubrication circuits 32 and 32A, but is of insufficient magnitude to effect the latching of the latching mechanism 34. The proportional solenoid regulator valve 14 discontinues communication of fluid pressure 30 to the switchable valvetrain component at time $t_2$. Similarly, at time $t_3$, the control unit 12 commands the proportional solenoid regulator valve 14 to provide fluid pressure at a pressure value $P_1$ to the switchable valvetrain component 16 and discontinues communication of fluid pressure 30 to the switchable valvetrain component 16 at time $t_4$. By selectively and intermittently communicating fluid pressure 30 from the pressurized fluid source 28 to the switchable valvetrain mechanism 16, the proportional solenoid regulator valve 14 provides the required fluid pressure 30 to adequately lubricate the valvetrain, via lubrication circuits 32 and 32A while minimizing the fluid flow requirements and the losses associated therewith. The fluid pressure value $P_1$ and the time intervals (i.e. $t_4$-$t_3$ and $t_2$-$t_1$) may be predetermined to provide optimal lubrication at various operating conditions such as engine speed, temperature, engine load, pressure of the pressurized fluid source 28, and fluid viscosity.

Upon receipt of the variable displacement mode activation flag or signal input 22 to the control unit 12, the control unit 12 will command the proportional solenoid regulator valve 14 to communicate fluid pressure from the pressurized fluid source 28 at a value of $P_2$. The fluid pressure value $P_2$ is substantially greater than the activation fluid pressure level (line 48) and is approximately equal to the supply pressure level. As such, the fluid pressure value $P_2$ is sufficient to enable operation or latching of the latching mechanism 34 of the switchable valvetrain component 16. By providing fluid at the relatively high fluid pressure level $P_2$, the switching response of the switchable valvetrain component 16 is increased and the variation in switching performance of the switchable valvetrain component 16 is reduced. The control unit 12 will maintain the fluid pressure value $P_2$ until time $t_6$ at which time the fluid pressure level is reduced to a pressure level $P_3$. The pressure level $P_3$ is greater than the holding fluid pressure level (line 50) and therefore the latching mechanism 34 is maintained in the latched state. The time interval $t_6$-$t_5$ is predetermined and should provide sufficient time to effect the latching of the latching mechanism 34. By initially increasing the fluid pressure value to $P_2$, the speed and reliability of operation of the latching mechanism 34 is increased and by subsequently reducing the fluid pressure value from $P_2$ to $P_3$, the fluid pressure and the losses associated therewith is reduced. At time $t_7$ the operation of the latching mechanism 34 is discontinued by reducing the fluid pressure value from $P_3$ to zero thereby decreasing the fluid pressure 30 supplied to the switchable valvetrain mechanism 16 below the holding fluid pressure level (line 50) such that the switchable valvetrain mechanism 16 is reactivated.

An exemplary method of operation is as follows: A) selectively and intermittently providing fluid pressure 30 to the lubrication circuits 32 and 32A of the switchable valvetrain component 16 at a first fluid pressure level $P_1$ wherein the first fluid pressure level $P_1$ is below the activation fluid pressure level (line 48) required to begin latching of the latching mechanism 34; B) determining whether the latching mechanism 34 should be latched; C) if so, providing fluid pressure 30 to the switchable valvetrain component 16 at a second fluid pressure level $P_2$ for a predetermined amount of time, i.e. the time interval $t_6$-$t_5$, wherein the second fluid pressure level $P_2$ is above the activation pressure level (line 48) to effect latching of the latching mechanism 34; D) subsequently, decreasing fluid pressure 30 to the switchable valvetrain component 16 to a third fluid level $P_3$ wherein the third fluid pressure level $P_3$ is below the second fluid level $P_2$ and above the holding pressure level (line 50) such that the latching of latching mechanism 34 is maintained; E) determining whether latching of the latching mechanism 34 should be discontinued; and F) if so, reducing fluid pressure 30 from the third fluid pressure level $P_3$ below the activation fluid pressure level (line 48) to discontinue latching of the latching mechanism 34.

While the discussion above has focused on a switchable valvetrain component 16 for use with a variable displacement valvetrain, the switchable valvetrain component 16 may be used within other valvetrain architectures requiring switching capabilities, such as so-called two-step valvetrain architectures operable to provide two distinct valve lifts in lieu of an active state and a deactivated state. While the best modes for carrying out the invention have been described in detail, those familiar with the art to which this invention relates will recognize various alternative designs and embodiments for practicing the invention within the scope of the appended claims.

What is claimed is:

1. A switchable valvetrain system comprising:

a control unit;

a pressure regulator valve responsive to control signals from said control unit;

a pressurized fluid source in communication with said pressure regulator valve;

a switchable valvetrain component having a latching mechanism and a lubrication circuit both in selective communication with said pressurized fluid source through said pressure regulator valve; and wherein said pressure regulator valve is operable to selectively and variably communicate fluid pressure at least three different pressure levels including a first fluid pressure below an activation fluid pressure required to effect latching of the latching mechanism, and said pressure regulator valve is further operable to prevent the communication of fluid pressure from said pressurized fluid source to said latching mechanism and said lubrication circuit in response to control signals from said control unit to adequately lubricate the switchable valvetrain system while limiting fluid flow and associated losses.

2. The switchable valvetrain of claim 1, wherein said pressure regulator valve is a proportional solenoid pressure regulator valve.

3. The switchable valvetrain of claim 1, wherein the switchable valvetrain component is a finger follower.

4. The switchable valvetrain of claim 1, wherein said control unit controls said pressure regulator valve via a pulse width modulation driver.

5. The switchable valve train of claim 1, wherein one of said at least three different pressure levels is a second fluid pressure level above the activation pressure level and substantially equal to a pressure level of the pressurized fluid source.

6. A method of controlling a switchable valvetrain component for an internal combustion engine wherein the switchable valvetrain component includes a latching mechanism and a lubrication circuit in selective series communication with a pressurized fluid source and wherein the latching mechanism is responsive to an activation pressure level operable to begin operation or latching of the latching mechanism and a holding pressure level, higher than the activation pressure level, effective to maintain the operation or latching of the latching mechanism, the method comprising:

selectively and intermittently switching between providing fluid pressure to the lubrication circuit of the valvetrain component at a first fluid pressure level and preventing the communication of fluid pressure to the lubrication circuit of the valvetrain component; wherein said first fluid pressure is below the activation fluid pressure required to effect latching of the latching mechanism to adequately lubricate the switchable valvetrain component while limiting fluid flow and associated losses.

7. The method of claim 6, further comprising:

providing fluid pressure to the valvetrain component at a second fluid pressure level wherein said second fluid pressure level is above the activation pressure level to effect latching of the latching mechanism; and subsequently, decreasing fluid pressure to the valvetrain component to a third fluid pressure level wherein said third fluid pressure level is below said second fluid level and above the holding pressure level such that the latching of latching mechanism is maintained.

8. The method of claim 7, further comprising reducing fluid pressure from said third fluid pressure level, below the activation fluid pressure level, to discontinue latching of the latching mechanism.

9. The method of claim 7, wherein providing fluid pressure to the valvetrain component at a second fluid pressure level includes holding said second fluid pressure level for predetermined amount of time to ensure the latching of the latching mechanism.

10. The method of claim 7, wherein said second fluid pressure level is substantially equal to the pressure level of the pressurized fluid source.

11. A method of controlling a switchable valvetrain component for an internal combustion engine wherein the switchable valvetrain component includes a latching mechanism and a lubrication circuit in selective series communication with a pressurized fluid source and wherein the latching mechanism is responsive to an activation pressure level operable to begin operation or latching of the latching mechanism and a holding pressure level, higher than the activation pressure level, effective to maintain the operation or latching of the latching mechanism, the method comprising:

selectively and intermittently providing fluid pressure to the lubrication circuit of the switchable valvetrain component at a first fluid pressure level wherein said first fluid pressure is below the activation fluid pressure required to effect latching of the latching mechanism;

determining whether the latching mechanism should be latched;

if so, providing fluid pressure to the switchable valvetrain component at a second fluid pressure level for a predetermined amount of time wherein said second fluid pressure level is above the activation pressure level to effect latching of the latching mechanism; wherein said predetermined amount of time is the time required to ensure the latching of the latching mechanism; wherein said second fluid pressure level is substantially equal to a pressure level of the pressurized fluid source;

subsequently, decreasing fluid pressure to the switchable valvetrain component at a third fluid level wherein said third fluid pressure level is below said second fluid level and above the holding pressure level such that the latching of latching mechanism is maintained;

determining whether latching of the latching mechanism should be discontinued; and if so, reducing fluid pressure from said third fluid pressure level below the activation fluid pressure level to discontinue latching of the latching mechanism.

* * * * *